US009427963B2

(12) United States Patent
Clippingdale et al.

(10) Patent No.: US 9,427,963 B2
(45) Date of Patent: Aug. 30, 2016

(54) PRINTHEAD CALIBRATION AND PRINTING

(71) Applicant: TONEJET LIMITED, Royston, Hertfordshire (GB)

(72) Inventors: Andrew Clippingdale, Royston (GB); Robin Timothy Bacon, Royston (GB); Ewan Hendrik Conradie, Royston (GB); Ammar Lecheheb, Royston (GB); John Lawton Sharp, Royston (GB); Jesse David Woolaston, Royston (GB)

(73) Assignee: Tonejet Limited, Royston, Hertfordshire (GB)

( * ) Notice: Subject to any disclaimer, the term of this patent is extended or adjusted under 35 U.S.C. 154(b) by 0 days.

(21) Appl. No.: 14/428,348

(22) PCT Filed: Sep. 17, 2013

(86) PCT No.: PCT/EP2013/069206
§ 371 (c)(1),
(2) Date: Mar. 13, 2015

(87) PCT Pub. No.: WO2014/041181
PCT Pub. Date: Mar. 20, 2014

(65) Prior Publication Data

US 2015/0224763 A1 Aug. 13, 2015

(30) Foreign Application Priority Data

Sep. 17, 2012 (EP) ..... 12184681

(51) Int. Cl.
*B41J 29/38* (2006.01)
*B41J 2/205* (2006.01)
(Continued)

(52) U.S. Cl.
CPC *B41J 2/12* (2013.01); *B41J 2/035* (2013.01); *B41J 2/205* (2013.01); *B41J 2/2103* (2013.01);
(Continued)

(58) Field of Classification Search
CPC .. B41J 29/393; B41J 2/04588; B41J 2/2139; B41J 2/2132; B41J 2/12; B41J 2002/022; B41J 2/2103
USPC ..... 347/9, 10, 12, 14, 15, 19
See application file for complete search history.

(56) References Cited

U.S. PATENT DOCUMENTS

2006/0181561 A1 8/2006 Takahashi et al.
2010/0060691 A1 3/2010 Tanase et al.
(Continued)

FOREIGN PATENT DOCUMENTS

WO WO 2012/040424 A2 3/2012

*Primary Examiner* — Jannelle M Lebron
(74) *Attorney, Agent, or Firm* — Dickinson Wright PLLC

(57) ABSTRACT

A method of calibrating a printhead, for printing two-dimensional bit-mapped images having a number of pixels per row, is disclosed for printheads (1) having a row of printing channels (5). During printing, in order to cause volumes of charged particulate concentrations of one of a number of predetermined volume sizes to be ejected from selected ejection channels of the printhead to form printed pixels, control pulse values of respective predetermined amplitude and duration, as determined by respective image pixel bit values, are applied to the selected printing channels. The calibration method comprises providing an image (50) that causes each channel of the printhead to be driven with the same pulse value, and printing one or more test prints of the image. The pulse value for all channels is then varied (101) in a set of defined steps within the test print or between the test prints and the optical density of the test print or test prints measured (102) at positions arranged on a grid (51) to obtain data of print density and pulse value at positions across the printhead. A desired tone reproduction curve (52) is pre-selected for the print process represented by optical density versus image grey level. Then pulse values are calculated (104) from the measured test print or test prints that are estimated to produce the desired values of print density corresponding to selected values of image grey level and which may include non-printing pulse values, and the pulse value for each of said positions across the printhead for each of said image grey levels is recorded in memory (105,106).

10 Claims, 17 Drawing Sheets

(51) Int. Cl.

| | |
|---|---|
| ***B41J 29/393*** | (2006.01) |
| ***B41J 2/12*** | (2006.01) |
| ***B41J 2/21*** | (2006.01) |
| ***B41J 2/035*** | (2006.01) |
| *B41J 2/02* | (2006.01) |

(52) U.S. Cl.
CPC ..... *B41J 2/2128* (2013.01); *B41J 2/2132* (2013.01); *B41J 2/2139* (2013.01); *B41J 2/2142* (2013.01); *B41J 29/393* (2013.01); *B41J 2002/022* (2013.01)

(56) References Cited

U.S. PATENT DOCUMENTS

| | | | |
|---|---|---|---|
| 2011/0234677 | A1 | 9/2011 | Tokunaga et al. |
| 2013/0021400 | A1* | 1/2013 | Tamagawa ..... 347/15 |

* cited by examiner

| | | Printhead channel number | | | | |
|---|---|---|---|---|---|---|
| | | 1 | 2 | 3 | ... | N |
| Dot size number | 0 | 0 | 0 | 0 | ... | 0 |
| | 1 | 81 | 80 | 79 | ... | 66 |
| | 2 | 108 | 107 | 106 | ... | 93 |
| | 3 | 130 | | | | |
| | 4 | 154 | | | | |
| | 5 | 177 | | Pulse values | | |
| | 6 | 202 | | | | |
| | 7 | 233 | | | | |

Figure 16

| | | Printhead channel number | | | | |
|---|---|---|---|---|---|---|
| | | **1** | **2** | **3** | **…** | **N** |
| **Dot size number** | **0** | 15 | 14 | 13 | … | 0 |
| | **1** | 81 | 80 | 79 | … | 66 |
| | **2** | 108 | 107 | 106 | … | 93 |
| | **3** | 130 | Pulse values | | | |
| | **4** | 154 | | | | |
| | **5** | 177 | | | | |
| | **6** | 202 | | | | |
| | **7** | 233 | | | | |

54

PRINTHEAD CALIBRATION AND PRINTING

BACKGROUND

The present invention relates to electrostatic inkjet print technologies and, more particularly, to printheads and printers of the type such as described in WO 93/11866 and related patent specifications.

Electrostatic printers of this type eject charged solid particles dispersed in a chemically inert, insulating carrier fluid by using an applied electric field to first concentrate and then eject the solid particles. Concentration occurs because the applied electric field causes electrophoresis and the charged particles move in the electric field towards the substrate until they encounter the surface of the ink. Ejection occurs when the applied electric field creates an electrophoretic force that is large enough to overcome the surface tension. The electric field is generated by creating a potential difference between the ejection location and the substrate; this is achieved by applying voltages to electrodes at and/or surrounding the ejection location.

The location from which ejection occurs is determined by the printhead geometry and the position and shape of the electrodes that create the electric field. Typically, a printhead consists of one or more protrusions from the body of the printhead and these protrusions (also known as ejection upstands) have electrodes on their surface. The polarity of the bias applied to the electrodes is the same as the polarity of the charged particle so that the direction of the electrophoretic force is towards the substrate. Further, the overall geometry of the printhead structure and the position of the electrodes are designed such that concentration and then ejection occurs at a highly localised region around the tip of the protrusions.

To operate reliably, the ink must flow past the ejection location continuously in order to replenish the particles that have been ejected. To enable this flow the ink must be of a low viscosity, typically a few centipoise. The material that is ejected is more viscous because of the concentration of particles; as a result, the technology can be used to print onto non-absorbing substrates because the material will not spread significantly upon impact.

Various printhead designs have been described in the prior art, such as those in WO 93/11866, WO 97/27058, WO 97/27056, WO 98/32609, WO 01/30576 and WO 03/101741, all of which relate to the so-called Tonejet® method described in WO 93/11866.

FIG. 1 is a drawing of the tip region of an electrostatic printhead 1 of the type described in this prior art, showing several ejection upstands 2 each with a tip 21. Between each two ejection upstands is a wall 3, also called a cheek, which defines the boundary of each ejection cell 5. In each cell, ink flows in the two pathways 4, one on each side of the ejection upstand 2 and in use the ink meniscus is pinned between the top of the cheeks and the top of the ejection upstand. In this geometry the positive direction of the z-axis is defined as pointing from the substrate towards the printhead, the x-axis points along the line of the tips of the ejection upstands and the y-axis is perpendicular to these.

FIG. 2 is a schematic diagram in the x-z plane of a single ejection cell 5 in the same printhead 1, looking along the y-axis taking a slice through the middle of the tips of the upstands 2. This figure shows the cheeks 3, the ejection upstand 2, which defines the position of the ejection location 6, the ink pathways 4, the location of the ejection electrodes 7 and the position of the ink meniscus 8. The solid arrow 9 shows the ejection direction and also points towards the substrate. Each upstand 2 and its associated electrodes and ink pathways effectively forms an ejection channel. Typically, the pitch between the ejection channels is 168 μm (this provides a print density of 150 dpi). In the example shown in FIG. 2 the ink usually flows into the page, away from the reader.

FIG. 3 is a schematic diagram of the same printhead 1 in the y-z plane showing a side-on view of an ejection upstand along the x-axis. This figure shows the ejection upstand 2, the location of the electrode 7 on the upstand and a component known as an intermediate electrode (10). The intermediate electrode 10 is a structure that has electrodes 101, on its inner face (and sometimes over its entire surface), that in use are biased to a different potential from that of the ejection electrodes 7 on the ejection upstands 2. The intermediate electrode 10 may be patterned so that each ejection upstand 2 has an electrode facing it that can be individually addressed, or it can be uniformly metallised such that the whole surface of the intermediate electrode 10 is held at a constant bias. The intermediate electrode 10 acts as an electrostatic shield by screening the ejection channel from external electric fields and allows the electric field at the ejection location 6 to be carefully controlled.

The solid arrow 11 shows the ejection direction and again points in the direction of the substrate. In FIG. 3 the ink usually flows from left to right.

In operation, it is usual to hold the substrate at ground (0 V), and apply a voltage, $V_{IE}$, between the intermediate electrode 10 and the substrate. A further potential difference of $V_B$ is applied between the intermediate electrode 10 and the electrodes 7 on the ejection upstand 2 and the cheeks 3, such that the potential of these electrodes is $V_{IE}+V_B$. The magnitude of $V_B$ is chosen such that an electric field is generated at the ejection location 6 that concentrates the particles, but does not eject the particles. Ejection spontaneously occurs at applied biases of $V_B$ above a certain threshold voltage, $V_S$, corresponding to the electric field strength at which the electrophoretic force on the particles exactly balances the surface tension of the ink. It is therefore always the case that $V_B$ is selected to be less than $V_S$. Upon application of $V_B$, the ink meniscus moves forwards to cover more of the ejection upstand 2. To eject the concentrated particles, a further voltage pulse of amplitude $V_P$ is applied to the ejection upstand 2, such that the potential difference between the ejection upstand 2 and the intermediate electrode 10 is $V_B+V_P$. Ejection will continue for the duration of the voltage pulse. Typical values for these biases are $V_{IE}$=500 volts, $V_B$=1000 volts and $V_P$=300 volts.

The voltages actually applied in use may be derived from the bit values of the individual pixels of a bit-mapped image to be printed. The bit-mapped image is created or processed using conventional design graphics software such as Adobe Photoshop and saved to memory from where the data can be output by a number of methods (parallel port, USB port, purpose-made data transfer hardware) to the printhead drive electronics, where the voltage pulses which are applied to the ejection electrodes of the printhead are generated.

One of the advantages of electrostatic printers of this type is that greyscale printing can be achieved by modulating either the duration or the amplitude of the voltage pulse. The voltage pulses may be generated such that the amplitude of individual pulses are derived from the bitmap data, or such that the pulse duration is derived from the bitmap data, or using a combination of both techniques.

The ejection characteristics of an electrostatic inkjet printhead are dependent on the geometry of the ejectors and on the positions of the electrodes at the ejector. Variation in these factors can lead to a variation in optical density or colour across a print.

The problem to be solved is to produce improved and more uniform ejection performance from an electrostatic inkjet print system whose raw performance produces a stable pattern of variation across the printhead. Prior knowledge of the characteristics of this variation enables the response of the print system to be calibrated to improve the uniformity of performance from the printhead significantly.

Electrostatic inkjet printheads can be controlled using the duration and/or amplitude of electrical pulses to the printhead ejectors to modulate the ejection from the ejectors. Unlike piezo or thermal inkjet printheads, in which the size of droplet ejected is primarily a function of the physical dimensions of the pressure chamber and nozzle, the volume of ink ejected from an electrostatic printhead ejector can be controlled by the amplitude and/or the duration of the electric field acting on the ink in the ejector, which in turn is determined by the voltage waveform applied to the electrodes of the printhead. This enables compensation for stable variations in the ejection performance across an array of ejectors to be achieved.

The ways in which the pulse duration and amplitude can be controlled are shown schematically in FIGS. 4A & 4B.

The volume of ink ejected in response to an applied voltage pulse is governed by the position of the ink meniscus, the electric field acting upon the ink and the duration of the applied pulse as described above. Ideally, every ejector in the printhead will perform equally, that is, will eject the same volume of ink at the same time for the same applied pulse. However, variation in ejector geometry, electrode positions or meniscus position across the printhead will cause variations in performance of ejectors leading to variation in the optical density of print across the width of the printhead. Such variation generally manifests as a gradual bow in print density from one side of the head to the other, is stable and characteristic of an individual printhead. As such, it can be compensated by choosing a set of pulse voltages and/or durations individually for each ejector or small groups of contiguous ejectors that equalises the print performance across the printhead. The calibration process both equalises the performance across the printhead and calibrates the tone reproduction curve (optical density versus image grey level) of the printhead in a single process.

Additionally, the response of the ink to an applied voltage pulse at an ejector is dependent upon the bias electric field (i.e. the electric field created by the application of the bias voltage to the ejector between ejections). In practice, the bias voltage $V_B$ is set just below the voltage $V_S$ at which spontaneous ejection occurs. It is important that $V_B$ is held close to $V_S$ (in practice about 20V below it) for the ink to respond rapidly to an ejection pulse. However, variations described above in ejector geometry and electrode positions can give rise to variation in $V_S$ across the printhead and consequently variation in the response of an ejector dependent on its position across the array.

US2006/018561 discloses a printer which adjusts for any variation in performance across the printhead by altering the pattern of dots which are needed to make up an image, thereby creating a new image, and then carrying out a standard transformation of that new image data into standard drive pulse values and hence into uncalibrated dot sizes. The calibration is achieved by creating a series of test prints for each channel in the printhead (see FIG. 8), so that the image data itself is calibrated rather than the ejected volume.

US2011/0234677 discloses a method of compensating for banding that occurs when a scanning printhead takes several interleaved passes to build up an image. Dark and light lines can result from errors in jet size and/or angle, and can result from the juxtaposition of certain nozzles on different passes, which don't have a one-to-one correspondence with individual nozzles. Hence, US2011/0234677 teaches making adjustments to the image (see FIG. 8) to compensate for banding in the print that is printed with a known interleaving scheme, which develops a characteristic pattern of banding from a given printhead. The correction would have to be re-done if a different interleaving scheme was used even for the same head. It specifically does not calibrate individual printhead channels by modification of print pulse values, but rather creates new image data which is then transformed into drive signals in a standard manner.

WO2012/040424 discloses colour profiling inkjet printing onto clear film. It involves printing a test pattern comprising greyscale patches, measuring the density of the greyscale patches, and adjusting output pixel values based on deviations between the expected and actual densities, all of which is well known colour profiling to achieve desired tone reproduction curves. WO2012/040424 teaches that the modification of pixel values is applied to the greyscale image before the image is then subjected to half-toning (screening to a small number of fixed dot sizes). This method does not carry out any dot size control (i.e. there is no control to the ejected volume to achieve a desired dot size) and as such, does not perform a correction of the printed dot sizes, but rather creates new image data which is then transformed into drive signals in a standard manner.

SUMMARY

According to the invention there is provided a method of calibrating a printhead for printing two-dimensional bitmapped images having a number of pixels per row, the printhead having a row of printing channels, wherein the volume of marking fluid ejected from each printing channel in use is independently controlled by respective control pulses determined by respective image pixel bit values, the calibration method comprising

- providing an image that causes each channel of the printhead to be driven with the same pulse value,
- printing one or more test prints of said image,
- varying the pulse value for all channels in a set of defined steps within the test print or between the test prints respectively,
- measuring the optical density of the test print or test prints at positions arranged on a grid to obtain data of optical print density and pulse value at positions across the printhead,
- selecting a desired tone reproduction curve for the print process represented by optical density versus image grey level,
- calculating pulse values from the measured test print or test prints that are estimated to produce the desired values of optical print density corresponding to selected values of image grey level and which may include non-printing pulse values, and
- recording in memory the pulse value for each of said positions across the printhead for each of said image grey levels.

In the types of printhead referred to in the prior art above, the control pulses are normally voltage pulses, but other possibilities exist for other printing technologies, for example, current pulses, pressure pulses, heat pulses, light pulses or the like.

The method also includes a method of printing a two-dimensional bit-mapped image having a number of pixels per row, the printhead having a row of ejection channels, each ejection channel having associated ejection electrodes to which a voltage is applied in use sufficient to cause particulate concentrations to be formed from within a body of printing fluid, and wherein, during printing, in order to cause volumes of charged particulate concentrations of one of a number of predetermined volume sizes to be ejected from selected ejection channels of the printhead to form printed pixels, voltage pulse values of respective predetermined amplitude and duration, as determined by respective image pixel bit values, are applied to the electrodes of the selected ejection channels, utilising the calibration method defined above, and printing said image utilising for each printed pixel the recorded pulse value corresponding to the required grey level for each position across said printhead.

Therefore the present invention utilises control of the ejected volume for each printed pixel so that the correct printed image can be created whilst compensating for any inherent variation in the performance of the channels across the printhead. The ejected volume is, due to the application of the voltage pulse $V_P$ for a given duration at a given amplitude, ejected as a single body of fluid and particulates which may, or may not depending upon the exact volume ejected and the printing conditions at the time, break into a series of droplets prior to landing on the substrate being printed. The ejected volume is therefore variously referred to as "printed droplets", "printed droplet", "droplet" or "volume".

A single test print of the image may be provided and the pulse values varied from maximum to minimum in the print direction along the test print prior to measuring the optical density.

Alternatively, the pulse values may be varied in the print direction along the test print to print a number of bands of print at different pulse values each corresponding to one of a desired set of dot sizes that are utilised by the printer in use to render images in conjunction with a suitable screening method.

In a further method, a plurality of blocks of print are provided in the test print, each block being printed by one of the ejection channels.

It is also desirable to use the in-built pulse control to supplement the effective value of the common, head-wide $V_B$ by superimposing on $V_B$ voltage pulses that are too short in duration and/or low in amplitude to cause printing, but which supplement $V_B$ by an amount which is predetermined according to the measurement of the raw performance of the printhead so that the difference between $V_S$ and the effective bias voltage is everywhere the same across the printhead. This method may further include the step of calibrating a non-ejecting, level of pulse values by extrapolating from the lowest printing level pulse values. This can be achieved by creating an effective bias level voltage for each channel, by selectively adding to the bias voltage of certain channels non-printing voltage pulses whose amplitude or duration is not sufficient to cause ejection.

Preferably, the step of recording in memory the pulse value for each of said positions across the printhead for each of said image grey levels, comprises storing said values in a memory forming part of the printhead.

The invention also includes method of printing a two-dimensional bit-mapped image having a number of pixels per row, the printhead having a row of ejection channels, each ejection channel having associated ejection electrodes to which a voltage is applied in use sufficient to cause particulate concentrations to be formed from within a body of printing fluid, and wherein, during printing, in order to cause volumes of charged particulate concentrations of one of a number of predetermined volume sizes to be ejected from selected ejection channels of the printhead to form printed pixels, voltage pulse values of respective predetermined amplitude and duration, as determined by respective image pixel bit values, are applied to the electrodes of the selected ejection channels, wherein the printhead is calibrated in accordance with any of the methods defined above.

The individual voltage pulse values determined by the respective image pixel bit values for printing the image may be modified in accordance with corresponding values stored in a look-up-table.

A calibrated scanner or scanning spectrophotometer may be used to capture the test print.

The Tonejet® method as referred to above has the feature that the ejection volume is continuously, addressably, variable through the mechanism of voltage pulse length control. In the Tonejet® method, for a given pixel level, a continuous-tone pulse value can be assigned to produce the desired dot size. Such calibrations are not possible for a conventional drop-on-demand (DOD) inkjet printhead whose drop volumes are quantised by chamber volume, nozzle size, etc.

Printheads of this type may have a single or multiple rows of ejection channels, the latter may form a two-dimensional array.

BRIEF DESCRIPTION OF THE DRAWINGS

Examples of methods and apparatus according to the present invention will now be described with reference to the accompanying drawings, in which:

FIG. 16 is an example of a look-up table of pulse values resulting from the calibration process of Example 4;

DETAILED DESCRIPTION

Before describing an example of the method according to the invention, it may be useful to describe the two methods generally usable to control the volume of fluid printed (or ejected) using the Tonejet® method.

Figure 1:
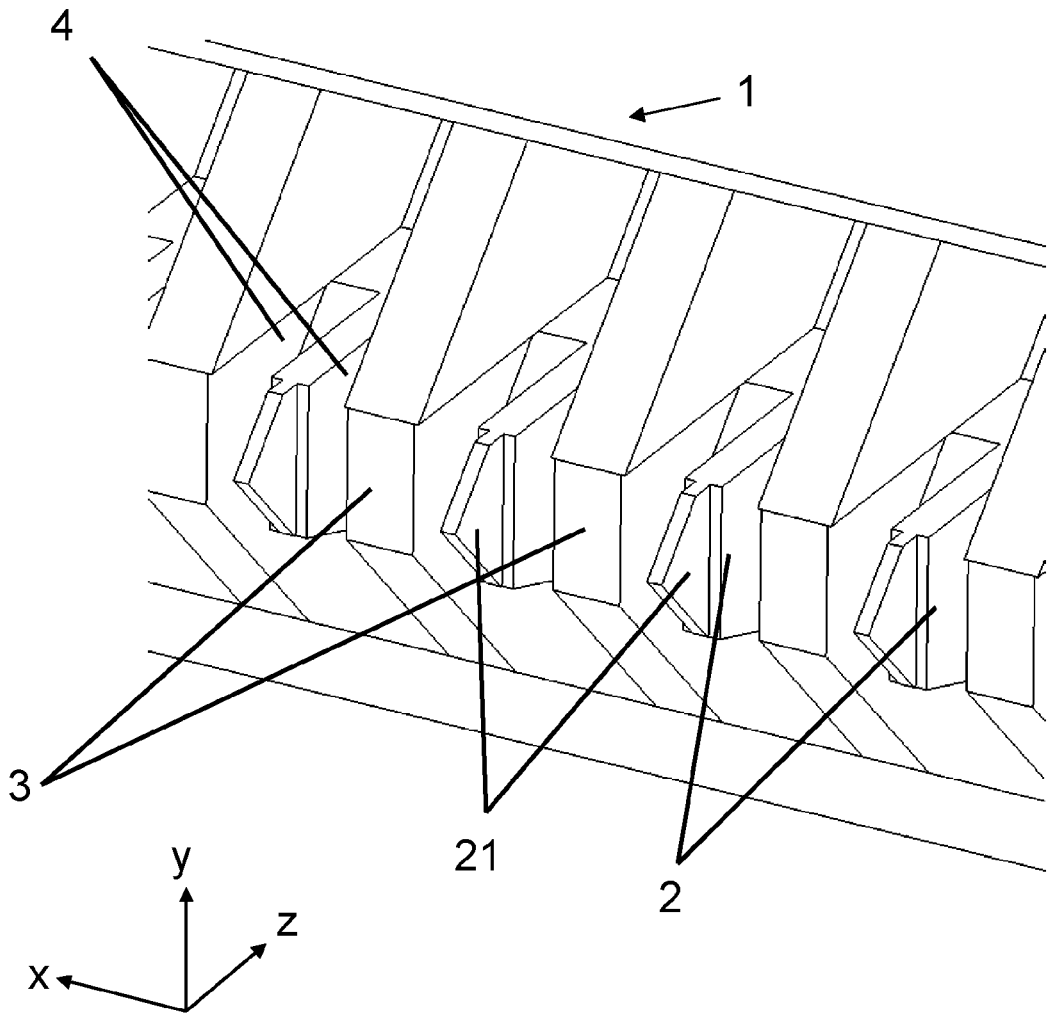
FIG. 1 is a CAD drawing showing detail of the ejection channels and ink feed pathways for an electrostatic printer.
Figure 2:
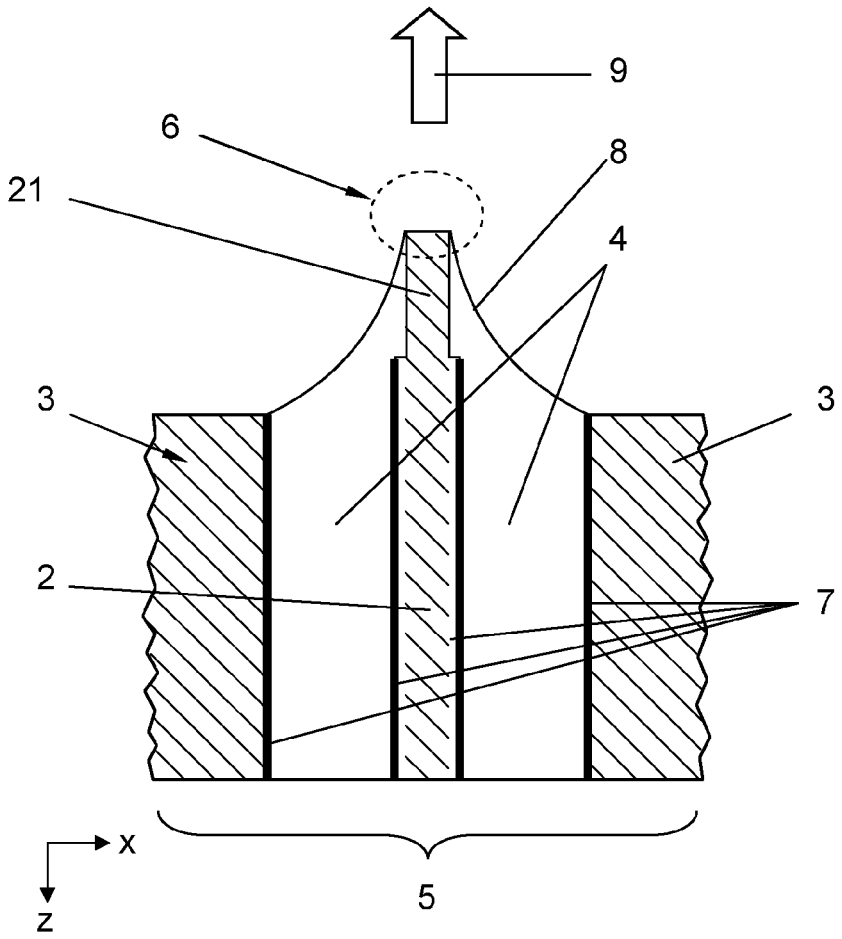
FIG. 2 is a schematic diagram in the x-z plane of the ejection channel in an electrostatic printhead of the type shown in FIG. 1.
Figure 3:
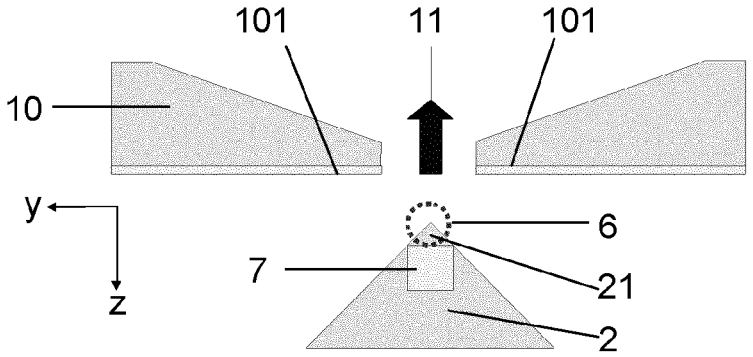
FIG. 3 is a schematic diagram in the y-z plane of the ejection channel in an electrostatic printhead of the type shown in FIG. 1.
Figure 4A:
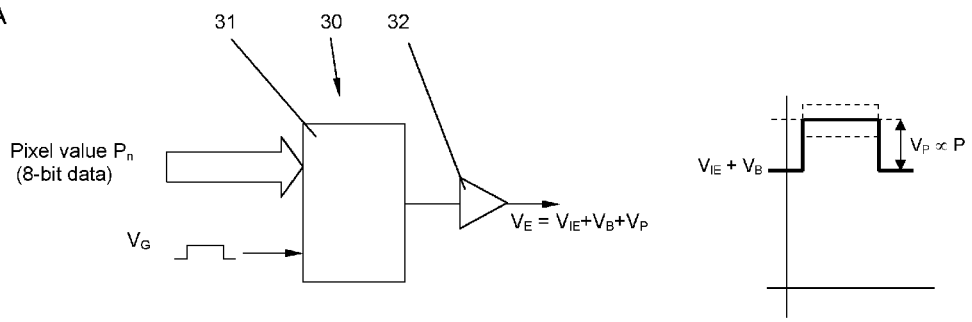
FIG. 4A is a block diagram illustrating how the amplitude of an ejection pulse can be adjusted and a related waveform diagram showing resulting illustrative adjusted amplitudes of a pulse.

FIG. 4A shows the block diagram of a circuit 30 that can be used to control the amplitude of the ejection voltage pulses $V_E$ for each ejector (upstand 2 and tip 21) of the printhead 1, whereby the value $P_n$ of the bitmap pixel to be printed (an 8-bit number, i.e having values between 0 and 255) is converted to a low-voltage amplitude by a digital-to-analogue converter 31, whose output is gated by a fixed-duration pulse $V_G$ that defines the duration of the high-voltage pulse $V_P$ to be applied to the ejector of the printhead. This low-voltage pulse is then amplified by a high-voltage linear amplifier 32 to yield the high-voltage pulse $V_P$, typically of amplitude 100 to 400V, dependent on the bit-value of the pixel, which in turn is superimposed on the bias voltages $V_B$ and $V_{IE}$ to provide the ejection pulse $V_E=V_{IE}+V_B+V_P$.

Figure 4B:
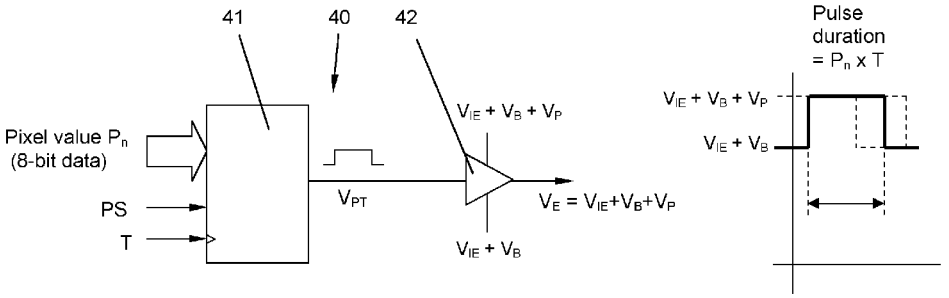
FIG. 4B is a block diagram illustrating how the duration of an ejection pulse can be adjusted and a related waveform diagram showing resulting illustrative adjusted durations of a pulse.

FIG. 4B shows the block diagram of an alternative circuit 40 that can be used to control the duration of the ejection voltage pulses $V_E$ for each ejector of the printhead 1, whereby the value $P_n$ of the bitmap pixel to be printed is loaded into a counter 41 by a transition of a "print sync" signal PS at the start of the pixel to be printed, setting the counter output high; successive cycles (of period T) of the clock input to the counter cause the count to decrement until the count reaches zero, causing the counter output to be reset low. The counter output is therefore a logic-level pulse $V_{PT}$ whose duration is proportional to the pixel value (the product of the pixel value $P_n$ and the clock period T); this pulse is then amplified by a high voltage switching circuit 42, which switches between a voltage ($V_{IE}+V_B$) when low to ($V_{IE}+V_B+V_P$) when high, thus generating the duration-controlled ejection pulse $V_E=V_{IE}+V_B+V_P$. The value of $P_n$ of the bitmap pixel to be printed (an 8-bit number, i.e having values between 0 and 255) corresponds to a duty cycle (of the ejection pulse) between 0% and 100%. Typically, when printing at a resolution of 600 dpi and with relative motion between the print substrate (not shown) and the printhead 1 being at a speed of 1 $ms^{-1}$, this equates to a pulse length of between 0 and 42 μm on a 42 μm pulse repetition period.

Of these alternative techniques, in practice it is simpler to modulate the duration of the pulse, but either technique may be appropriate in given circumstances and both may be used together.

In practice of course, a printed colour image is produced by using multiple single-colour printheads, each of which is used to print one of several colour components (for example CMYK). The following description applies to each printhead, and the calibration process is repeated for each printhead. For simplicity the process is described once only.

Example 1

Figure 5:
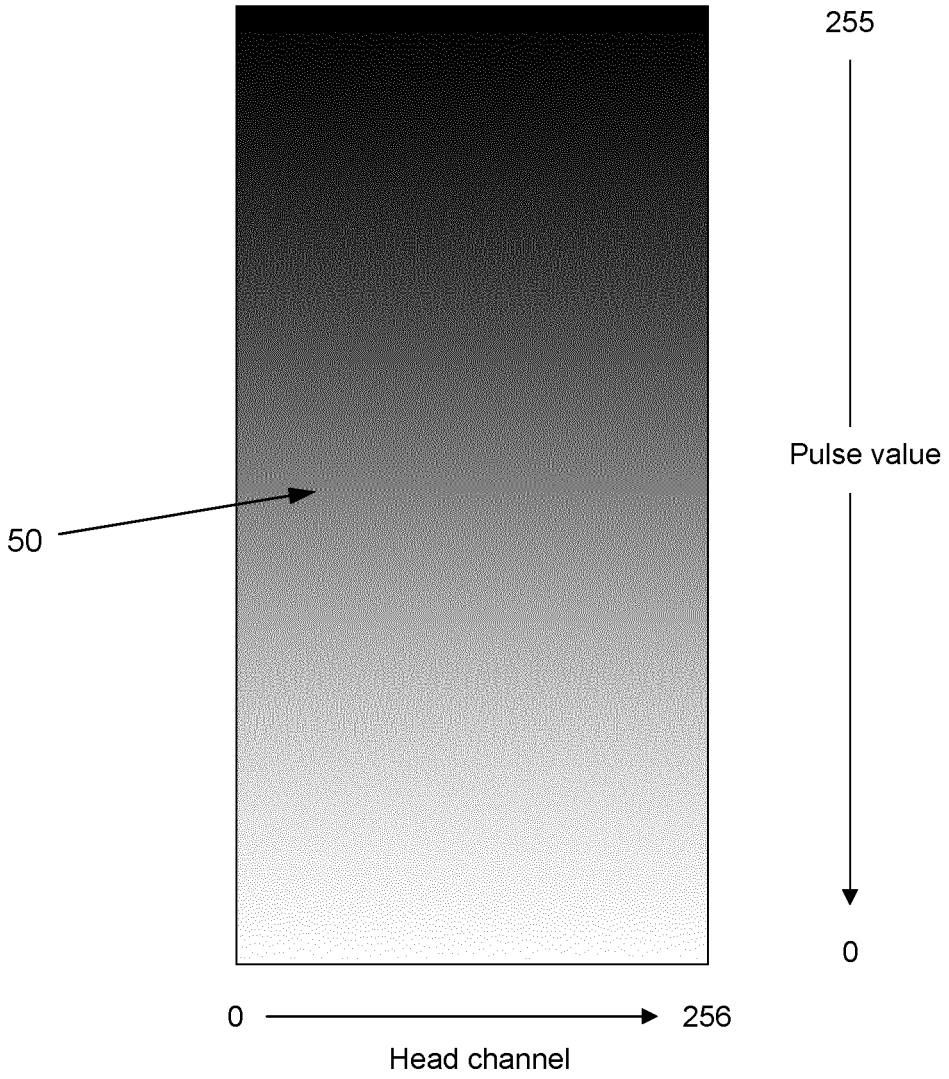
FIG. 5 shows a test print of an image used in the calibration process of a first example, Example 1, of the invention.
Figure 11:
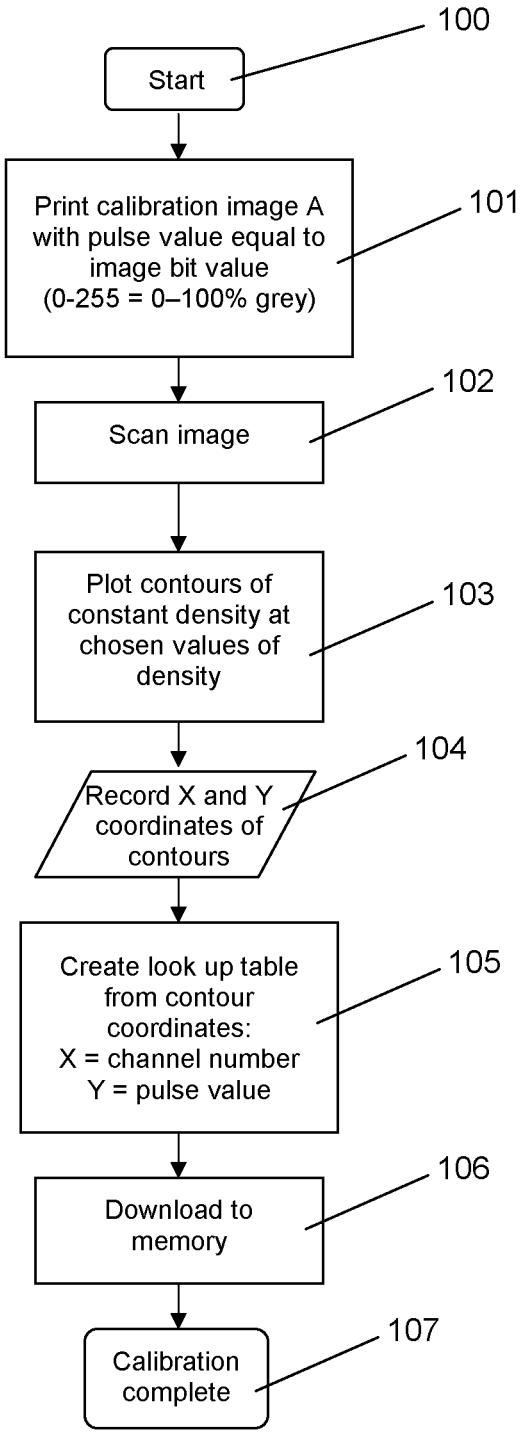
FIG. 11 shows a flow diagram describing the calibration process according to a first example, Example 1, of the invention.

The calibration process according to a first example of the invention, and which is illustrated in FIG. 11, first involves, after the start at step 100, a step 101 of printing a test print 50 of an image (see FIG. 5) that causes the drive electronics of the printhead to drive each ejection channel across the whole width of the printhead 1 with the same pulse value, the pulse value being varied in the print direction in defined steps from a maximum (255) to zero (0).

Figure 6:
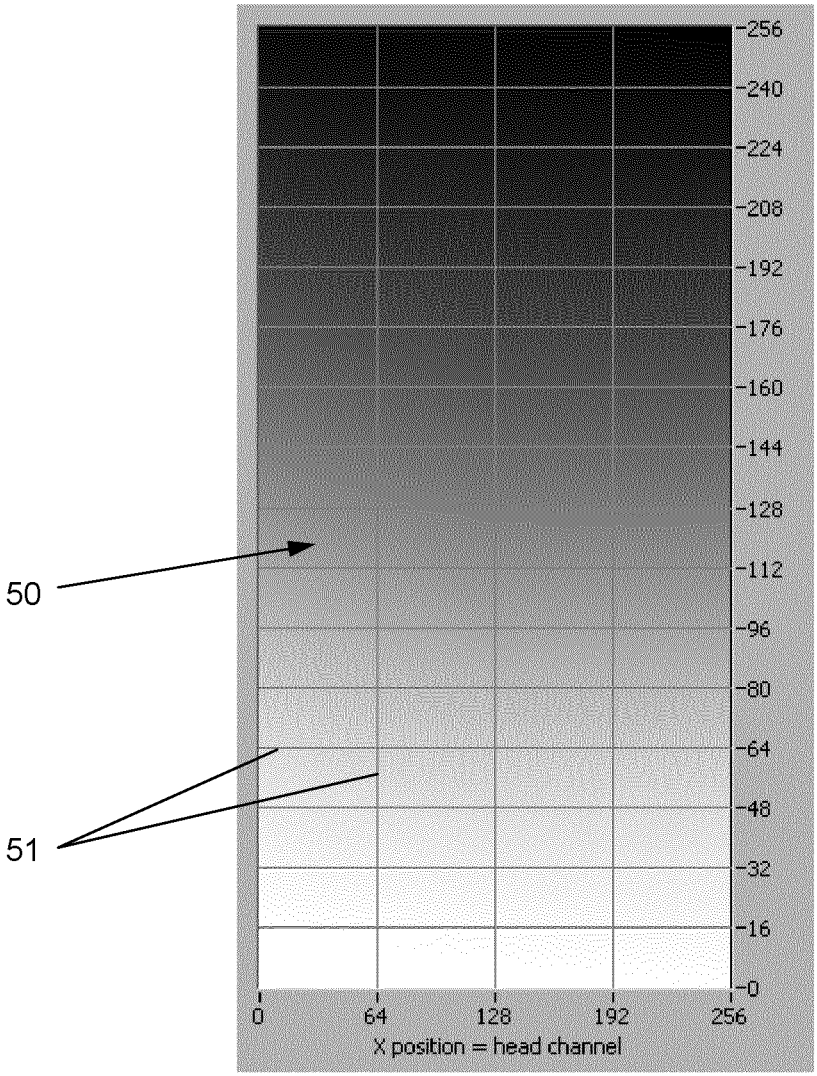
FIG. 6 shows a scanned version of the test print of the image of FIG. 5.

The test print is then, preferably automatically, passed to a scanner and the image scanned (step 102). FIG. 6 shows a scanned version of the test print image 50 with a grid 51 superimposed to show printhead channel number on the horizontal axis (x-axis) and pulse value on the vertical axis (y-axis). The optical density of the test image 50 is then measured by the scanner at positions arranged on the regular grid to obtain data of print density versus pulse value at regular positions across the printhead. This is carried out, in this example, by utilising a calibrated scanner (not shown) which is used to capture the test print resulting in the scanned image as shown in FIG. 6.

Figure 7:
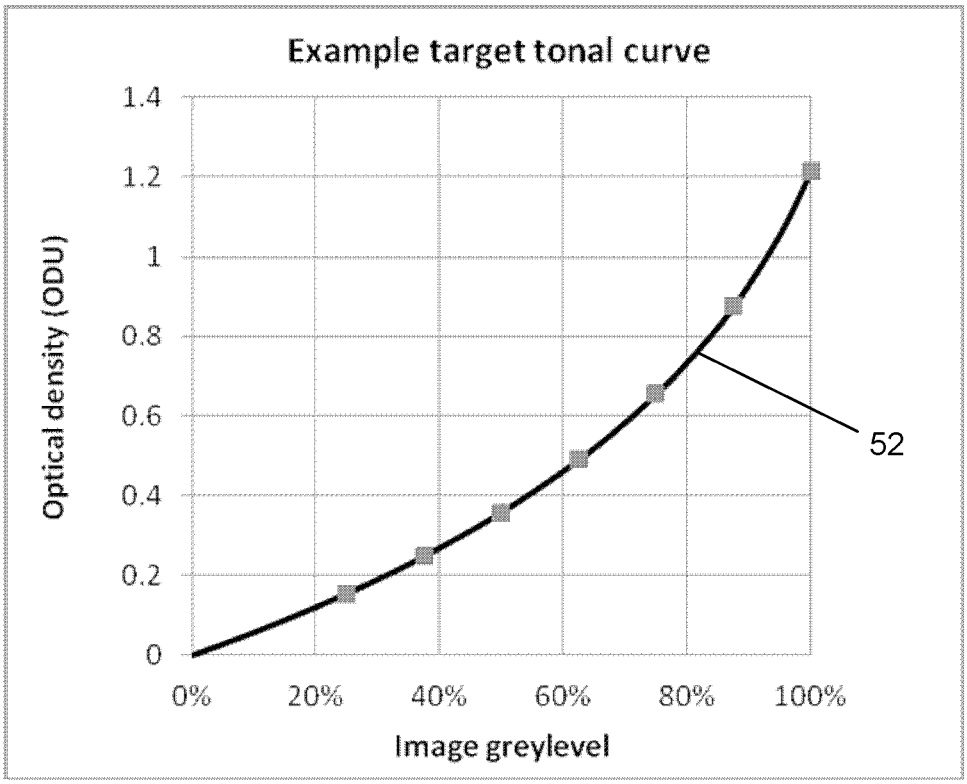
FIG. 7 shows the desired tone reproduction curve (optical density versus image greyscale level) for a print process according to one example of the invention.

The desired tone reproduction curve 52 (optical density versus image greyscale level) for the print process (an example of which is shown in FIG. 7) is preselected. This curve determines how the image pixel values are ultimately translated into ink density on the print with the aim of producing in the print the same perceived grey levels and colour as the original image. This depends on how colour is represented in the original image pixel values, i.e. the colour encoding specification of the image, which is commonly embedded in the image data file. Colour encoding specifications are well known in the field of digital printing and are not described further here. The tone reproduction curve can also depend on the substrate material being printed as a result of, for example, different colour and absorbency, and it is common to create (in a separate operation not part of the invention) curves corresponding to different substrate materials.

Prints are typically rendered from a small number of discrete dot sizes, e.g. four or eight, in a screened pattern, rather than in continuous tone. This has the advantage of reducing the bit depth of data required to define each pixel thereby allowing faster and more efficient data handling and transfer from the controlling computer to the printheads. An area of image grey level that coincides with one of these discrete dot sizes is typically rendered using that single dot size to print every pixel in the area; by contrast, image grey levels that lie between two discrete dot sizes are rendered with randomised distributions of those two dot sizes in the correct proportion to achieve the desired print density. Image grey levels lighter than the minimum dot size are rendered using randomised distributions of the minimum dot size. The screening process is applied to the image data as part of the raster image processing that is performed automatically in the controlling computer. Such screening methods are well known in the field of digital printing and are not described further here.

The curve 52 of FIG. 7 shows seven values corresponding to the dot sizes that will be used to render images in conjunction with a suitable screening method.

Figure 8:
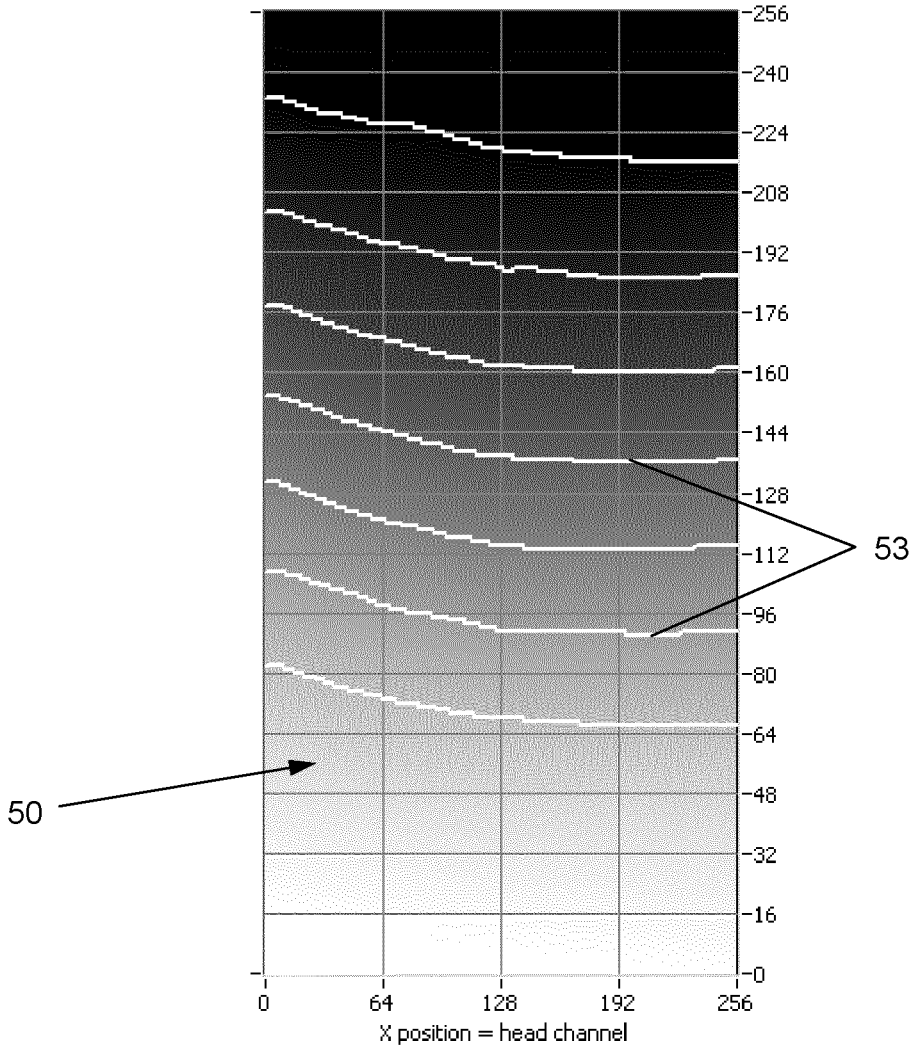
FIG. 8 shows the scanned image of FIG. 6 with seven contours of constant print density overlaid on the scanned test print.

In step 103 seven contours 53 of constant print density corresponding to the chosen dot sizes from which to render the image are calculated, within a computer attached to the scanner, from the image scanned by the scanner and representations of these are shown in FIG. 8 overlaid on the scanned test print 50. It will be appreciated that the y-coordinate value of a contour for each position x in FIG. 8 is the pulse value that creates the required print density for the image greyscale level specified for that contour. These coordinates are recorded in step and the data is used (step 105) to populate a look-up table (LUT) 54, part of which is reproduced in FIG. 9. The LUT data is then stored in a memory associated with the printhead (step 106) and then the calibration process ends at step 107. The LUT data can be used during printing to transform image pixel data supplied to the printhead into pulse value data to reproduce the image to the accuracy desired. This process is described later in conjunction with FIG. 18.

Figures 9, 10:
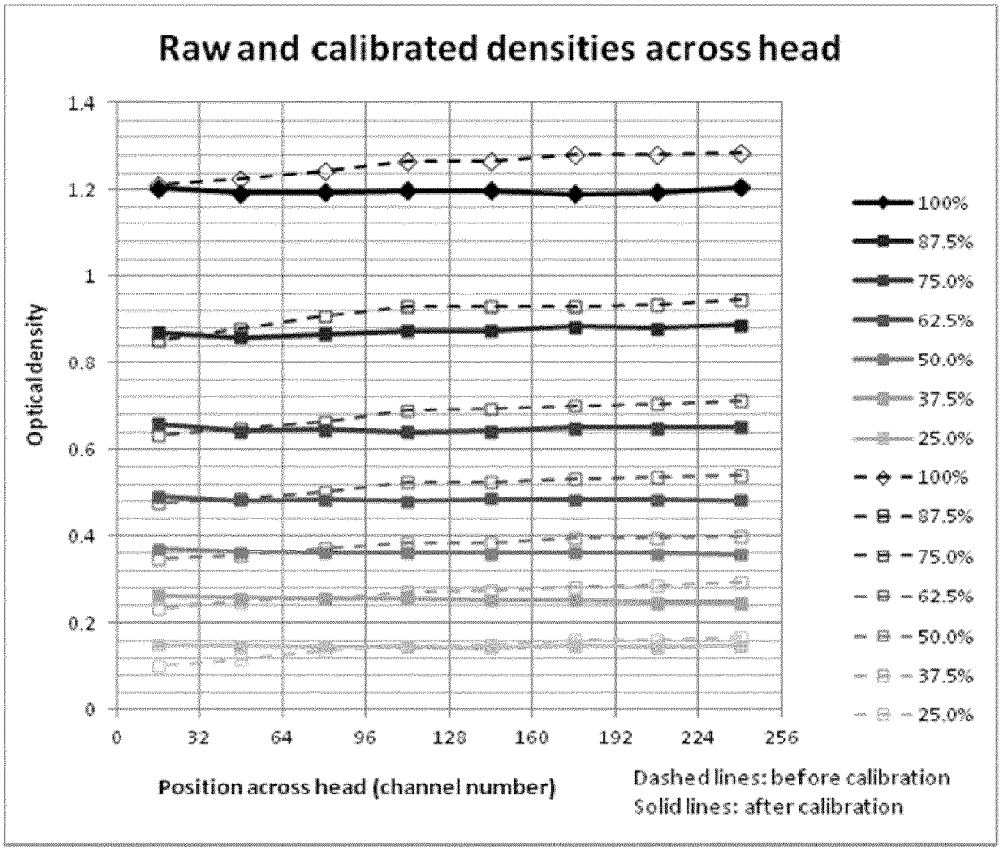
FIG. 9 is an example of a look-up table of pulse values resulting from the calibration process.
FIG. 10 illustrates the initial and calibrated optical densities (y-axis) across the printhead channels (x-axis)

FIG. 10 illustrates the initial and calibrated optical densities (y-axis) across the printhead channels (x-axis) for the levels of print density utilised in the calibration process. The calibration process has reduced the variation in optical density across the printhead at each dot size level shown from around 0.1 to less than 0.03 (optical density measurements made using GretagMacbeth Spectrolino spectrophotometer using DIN density standard relative to paper substrate).

Example 2

Figure 12:
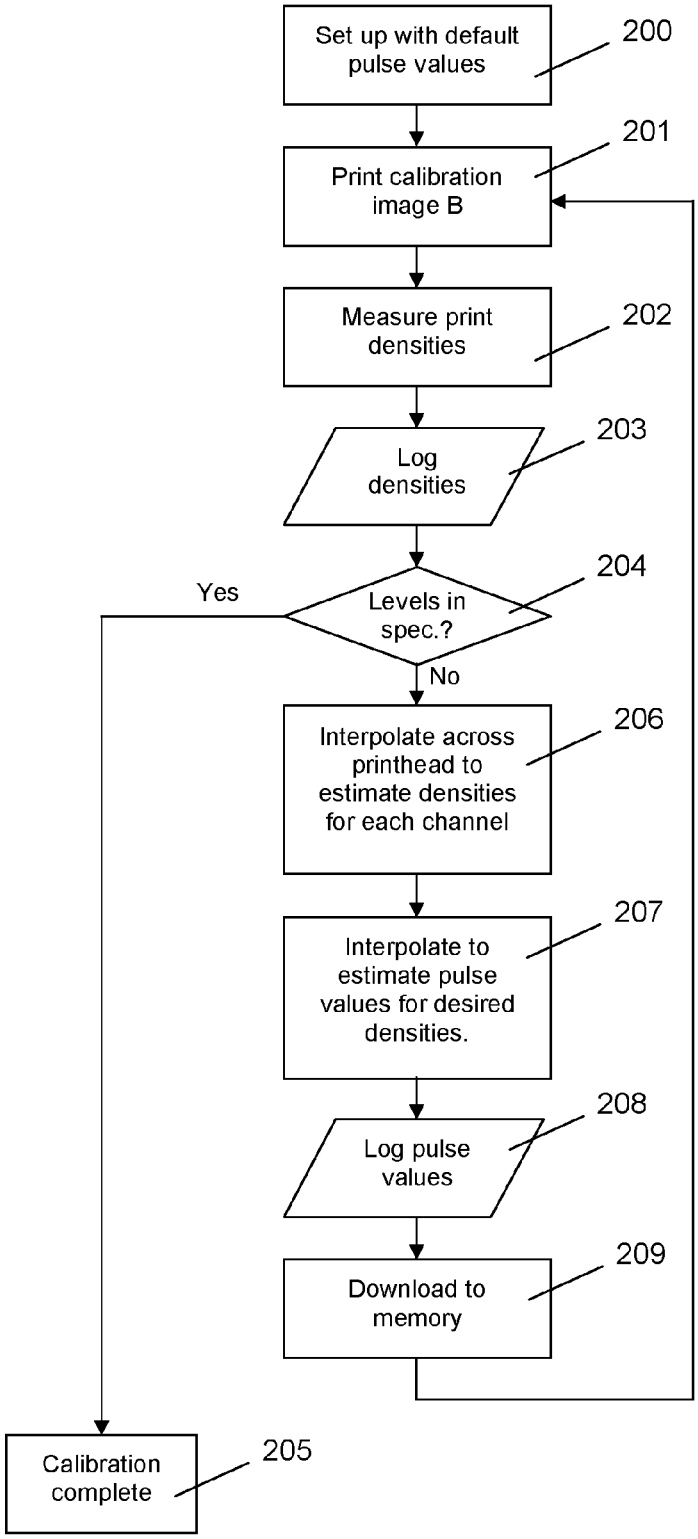
FIG. 12 shows a flow diagram describing the calibration process according to a second example, Example 2, of the invention.

The calibration process according to a second example of the invention is described with reference to the flow diagram of FIG. 12. The process first involves setting up the printhead with a set of default values (step 200) and printing (step 201) a test image (calibration image) such as that of FIG. 13 that causes the printhead drive electronics to drive each ejection channel across the whole width of the printhead 1 with the same pulse value. The pulse value is varied in the print direction so as to print a number of bands 55.1 to 55.7 of print at different pulse values each corresponding to one of the desired set of dot sizes that are used to render images in conjunction with a suitable screening method.

Figure 13:
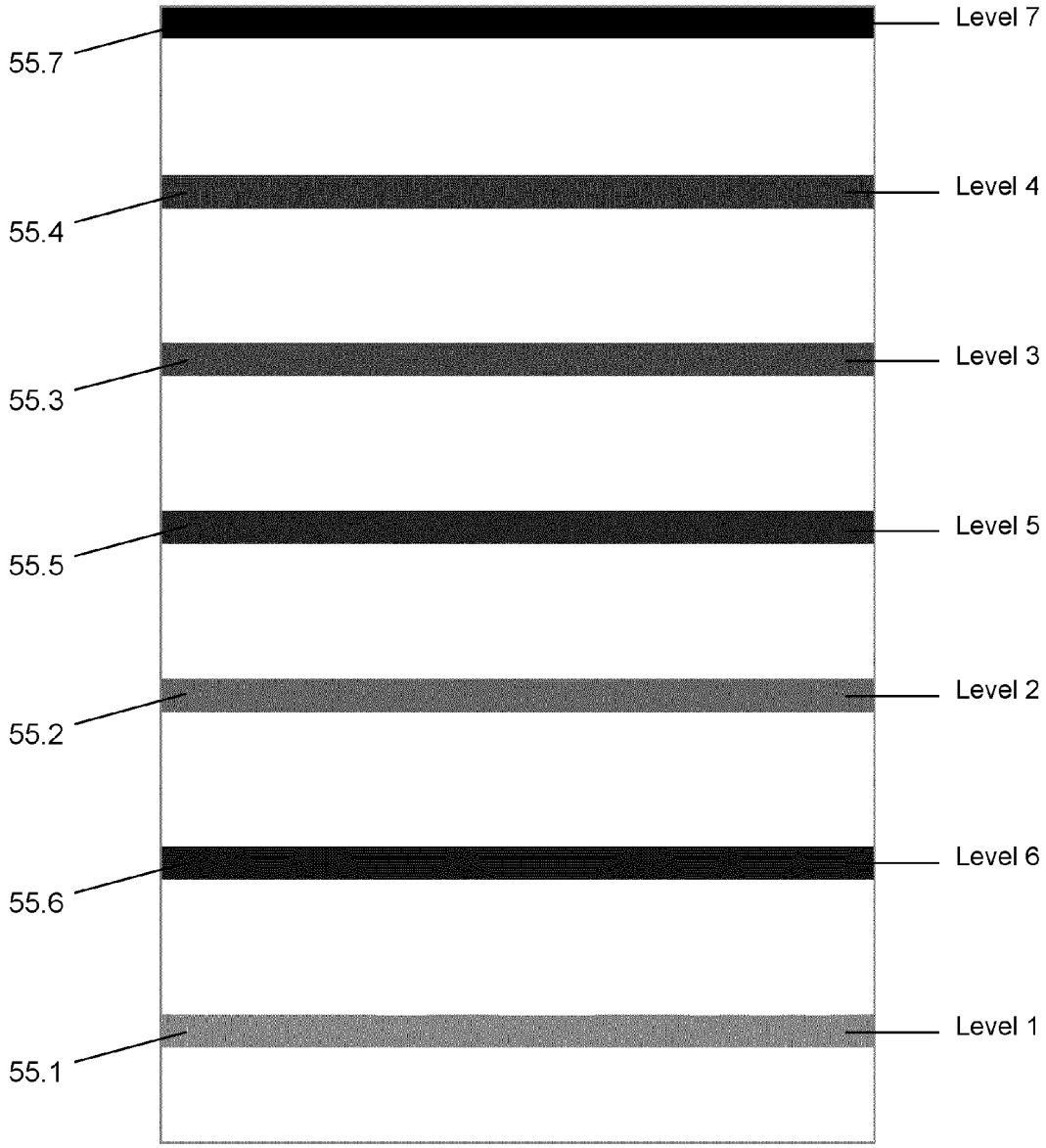
FIG. 13 shows a suitable calibration test image for Example 2.

The optical density of the test image of FIG. 13 is then measured as before (step 202) using a suitable scanner, at positions arranged on a regular grid across the print to obtain data of print density versus pulse value at regular positions across the printhead. The densities are logged in computer memory (step 203) and examined to determine whether the levels are within specification (step 204). The levels are examined within the computer to determine whether or not they are within specification by comparing the measured densities across the head for a particular level with the target density for that level; the measured densities should all lie within a chosen allowable error of the target value, which typically is 0.05 ODU, but could be more or less than this depending on the print quality requirements of the application.

If the print density uniformity is within specification no further action is taken and the calibration is complete (step 205). If it is not, then interpolation between the density measurements across the printhead is performed (step 206) to approximate individual channel densities from the area density measurements (which are typically at a lower spatial resolution than the channels of the printhead). Linear interpolation between the density measurements is generally sufficient to approximate the shape of the variation across the printhead and give a sufficient estimate of the performance of the individual channels.

To calculate the pulse values that give the desired densities, a further interpolation step (step 207) is employed in which the density error is calculated as the measured (or interpolated) channel density minus the target density for each printing level. A pulse value correction is calculated as (density error)/$k_L$, where $k_L$ is a constant for each level chosen to be about 20% higher than the typical gradient of the curve of density versus pulse value at each level. This gives a correction value that slightly under-compensates the density error so that after two or three iterations (see below) the values are converged on the specified levels in a stable progression. $k_L$ typically ranges from 0.005 ODU per increment of pulse value at the lowest level of greyscale used in the printing process to 0.011 ODU per increment of pulse value at the maximum level. The computer then calculates the new pulse value as the prior pulse value minus the pulse value correction for each greyscale level for each channel.

These calculated pulse values are logged (step 208) and saved to memory (step 209), preferably within the printhead. A further test (calibration) print is printed using the pulse values so determined, and the process is repeated until the uniformity of the printed bands is within specification. Typically two iterations of this process will deliver the desired uniformity.

Example 3

A calibration process according to a third example of the process is described with reference to the flow diagram of FIG. 14. This process differs from that of Example 2 in as much as a calibration test image is used that produces measurable patches 61 (see FIG. 15B) for each individual printhead channel, so that the step of interpolating between density measurements to estimate channel performance is not required.

Figure 14:
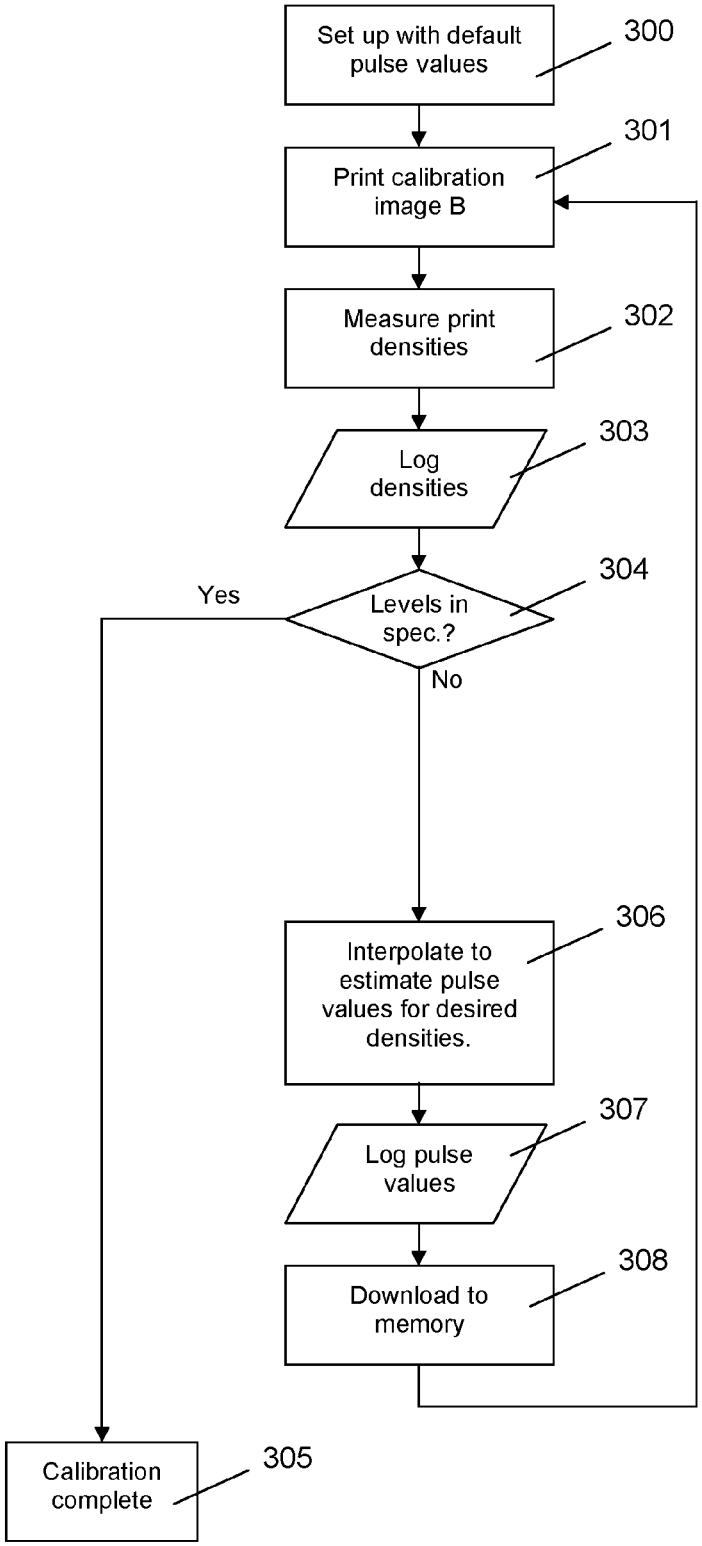
FIG. 14 shows a flow diagram describing the calibration process according to a third example, Example 3, of the invention.
Figure 15A:
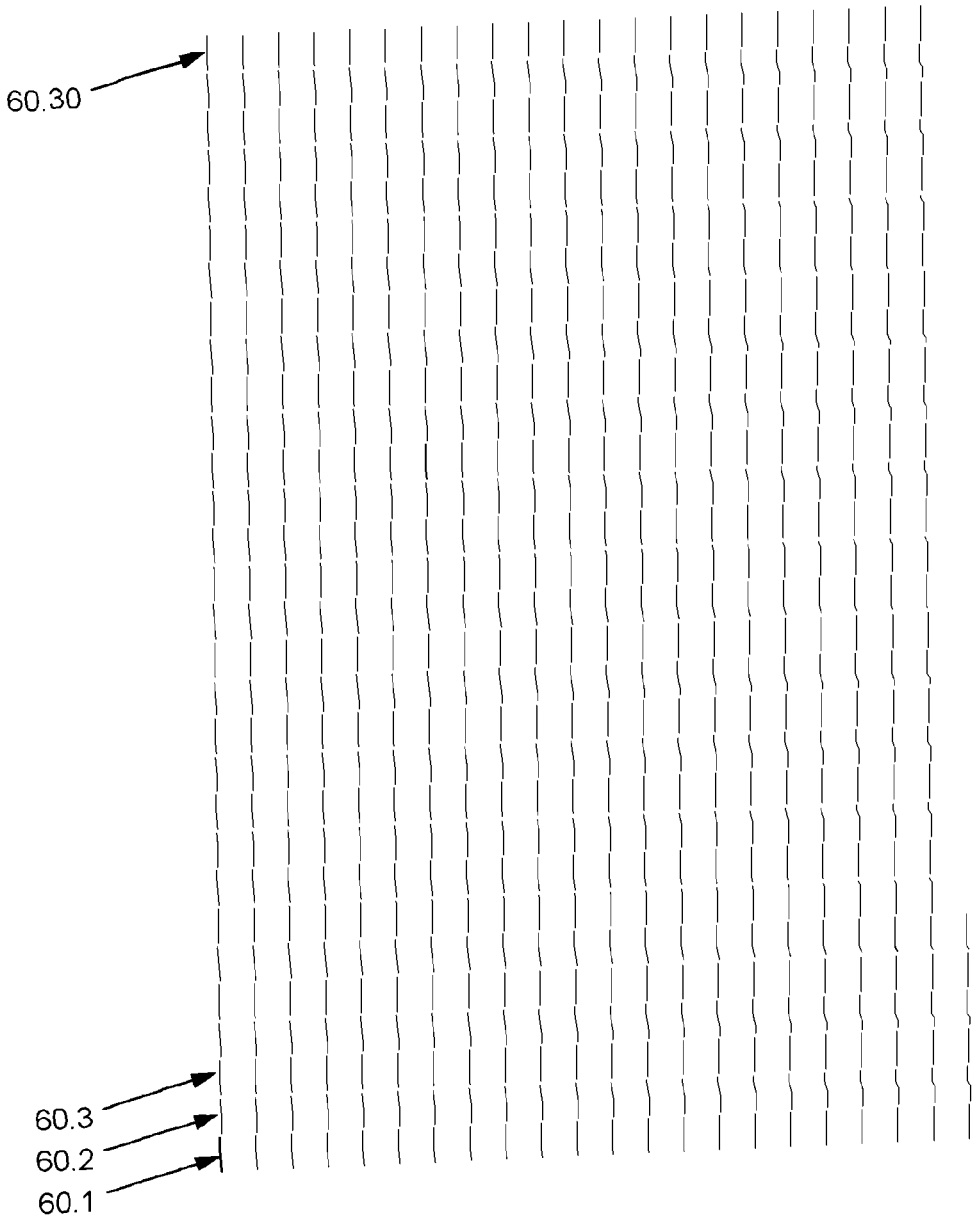
FIG. 15A shows a suitable calibration test image for Example 3.
Figure 15B:
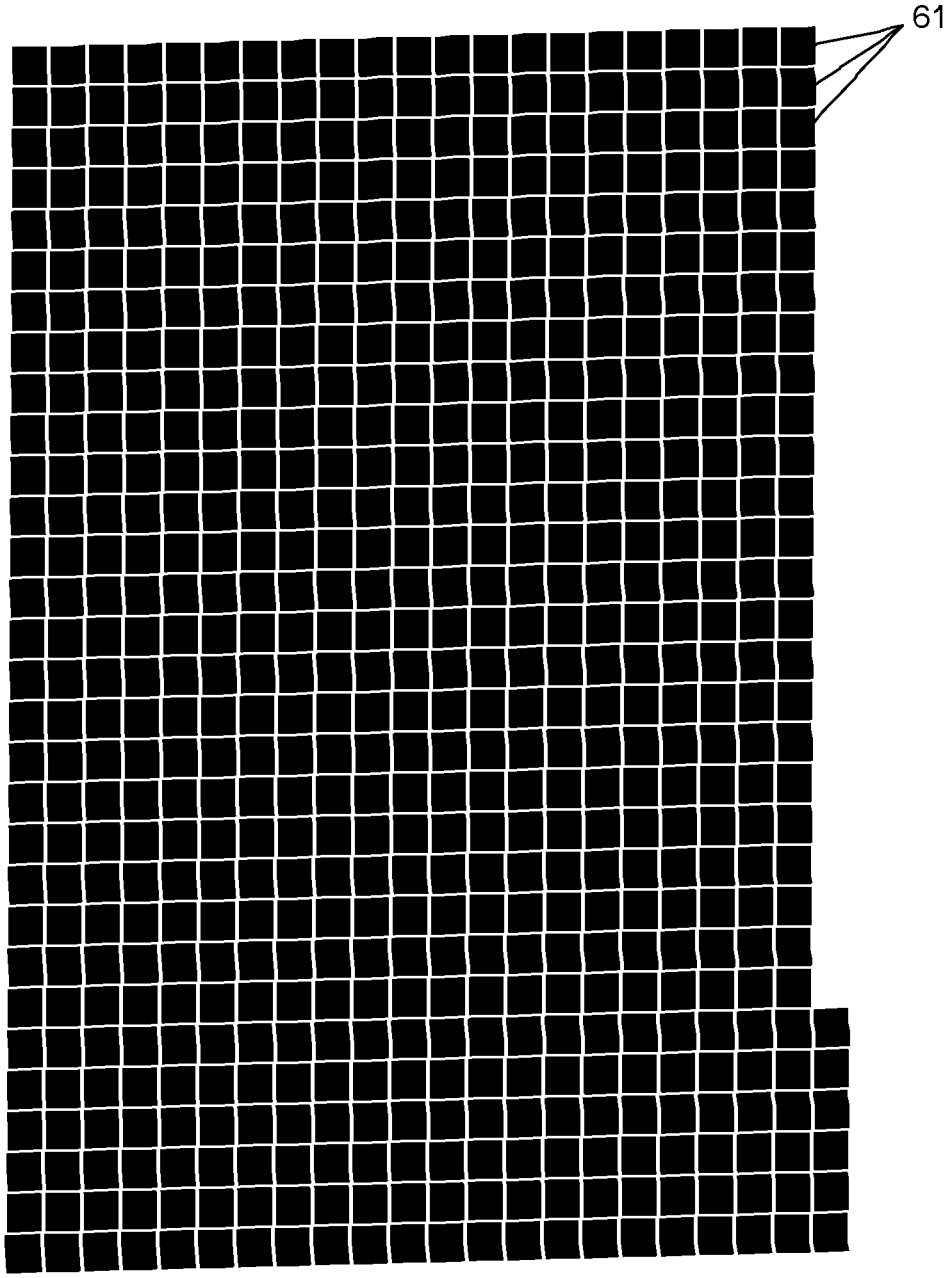
FIG. 15B illustrates the result of printing the calibration image of FIG. 15A one hundred times with a step of one pixel pitch between prints to create print patches suitable for optical density measurement that are each printed by an individual channel of the printhead.

As FIG. 14 illustrates the process first involves setting up the printhead with a set of default values (step 300) and then a test image (calibration print) is printed in step 301. A suitable test print is shown in FIGS. 15A and 15B and consists of a first set of lines 60.1 each about 4 mm long printed from every 30th channel of the printhead, e.g. channels 1, 31, 61, etc. After this first set of lines, the channel numbers addressed are repeatedly incremented by one resulting in further set of lines 60.2 from channels 2, 32, 62, etc. and so on until row 60.30 and every channel of the printhead has printed a line (see FIG. 15A). This pattern is then overprinted about 100 times with a single pixel pitch increment of the printhead to the right relative to the substrate between each pass to build up the final test print of FIG. 15B, which results in an individual square patch for each of the printhead channels.

In order to calibrate the printhead according to this example, a set of test prints of the type shown in FIG. 15B is printed, each corresponding to the one of the desired sets of dot size levels to use for rendering images.

The optical density of the patches 61 of the test images of FIG. 15B type are then measured as before (step 302) using a suitable scanner, to obtain data of print density versus pulse value for each channel of the printhead. The densities are logged in computer memory (step 303) and examined to determine whether they are within specification (step 304). As in Example 2, levels are examined within the computer to determine whether or not they within specification by comparing the measured densities across the head for a particular level with the target density for that level; the measured densities should all lie within a chosen allowable error of the target value, which typically is 0.05 ODU but could be more or less than this depending on the print quality requirements of the application.

The density measurements from these prints are used according to the flow diagram of FIG. 14 to estimate the pulse values required from each channel to achieve the desired dot size levels, the interpolation step, step 306, being substantially the same as step 207 in Example 2. These pulse levels are logged (step 307) and saved to memory (step 308) and a further set of test (calibration) prints produced (step 301) using the pulse values so determined, and the process repeated until the uniformity of the output from each printhead channel is within specification. Typically two iterations of this process will deliver the desired uniformity.

Example 4

Any of examples 1 to 3 may include an additional step of creating a level 0 (effective bias) by extrapolating down from level 1. As explained earlier, the magnitude of the bias voltage $V_B$ is chosen such that an electric field is generated at the ejection location 6 that concentrates the particles, but does not eject the particles. Ejection spontaneously occurs at applied biases of $V_B$ above a certain threshold voltage, $V_S$, corresponding to the electric field strength at which the electrophoretic force on the particles exactly balances the surface tension of the ink. It is therefore always the case that $V_B$ is selected to be less than $V_S$. For of the response of ejectors to print pulses to be equal it is desirable for the difference $V_B-V_S$ to be the same across the printhead; however it is common for $V_S$ to exhibit variation across the printhead for the same reasons and in the same way that the ejection strength can show variation. The variation in $V_B-V_S$ can be reduced, or eliminated, by creating an effective bias level, level 0, which is created by selectively adding to the bias voltage of certain channels non-printing voltage pulses whose amplitude or duration is not sufficient to cause ejection but which raises the time-averaged value of the voltage at the ejector a small amount above $V_B$.

Such a calibration process performs a calibration of the non-ejecting effective bias level (level 0) by extrapolating down from the lowest printing level (level 1). In the simplest case this is done by subtracting a constant number from the pulse values of level 1, that number being the minimum of the calibrated pulse values for level 1. This is illustrated by the example look-up table of FIG. 16. The result is a constant difference between the effective bias and the first printing level, with the aim of equalising the response of the ejectors to a print pulse across the printhead.

In all examples above it is noted that the calibrated pulse values are stored in memory. This memory may be contained in a so-called "smart chip" built into the printhead to hold the calibration data thus obtained, and which uploads the data in the form of a LUT to the printhead drive electronics on power up. This has the advantage of ensuring substantially identical printing in such smart chip equipped printheads in response to incoming print data.

Figure 17:
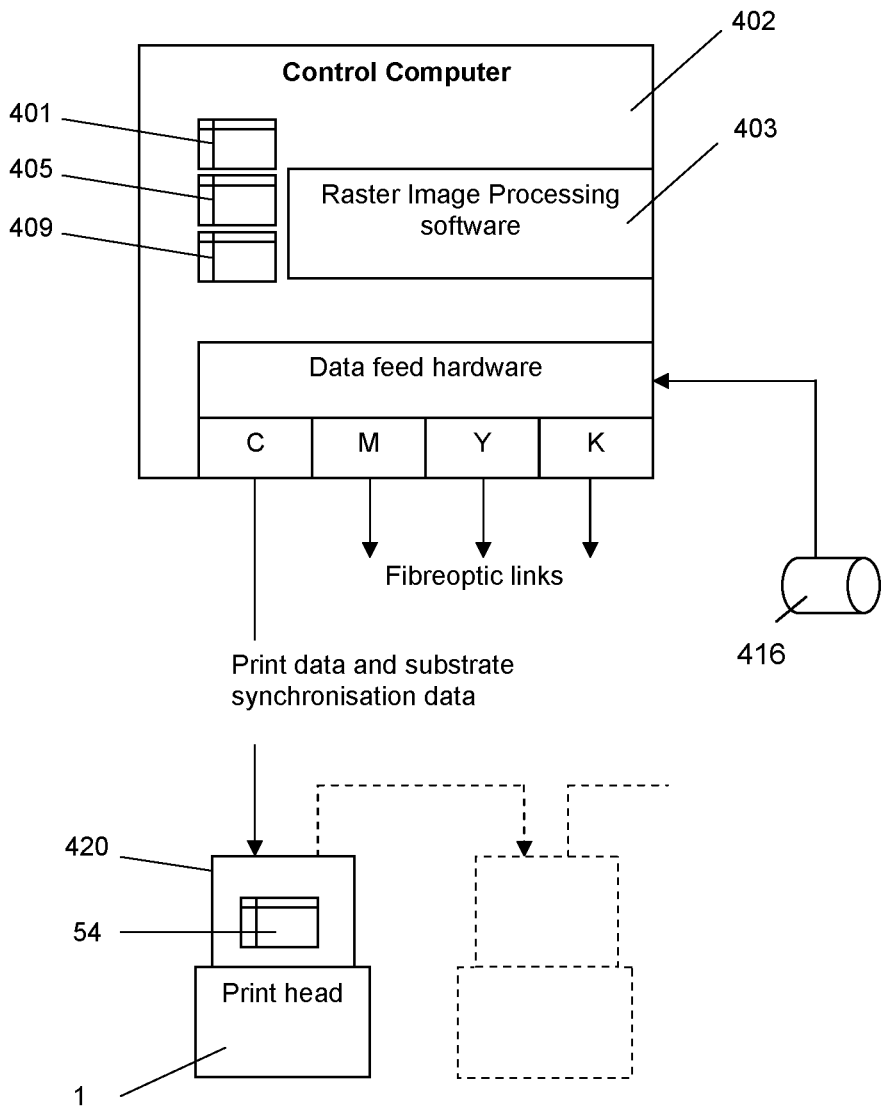
FIG. 17 is a block diagram of some of the printer components used in printing an image from a printer calibrated in accordance with the invention.

In operation of a printhead calibrated in accordance with any of the examples described above, as shown in FIGS. 17 and 18, a colour image 400, for example created by using (say) any one of a number of well-known image creation software packages such as Adobe Illustrator, is uploaded into a memory 401 of a computer 402. The initial image 400 is then rasterised within the computer 402 using image processing software 403 and a corresponding colour bitmap image 404 is then created and saved in memory 405. A colour profile 406 is then applied to the bitmap image to apply rules for separation of the colour image into the process primary colours (typically cyan, magenta, yellow and black) and each pixel is then 'screened' 407 so that each colour component of the pixel is filtered into one of a number (n) of different 'levels' (e.g. FIGS. 13, 55.1 to 55.7) and the data, representing in this case the CMYK n-level image 408, is then stored in RAM 409 and the individual primary colour components separated 410 into respective data sets 412*c*, 412*m*, 412*y* and 412*k*.

In the case where multiple printheads are employed to print each colour separation, for example where printheads are joined end to end to span a substrate that is wider than the individual head width, of interleaved to provide a greater number of dots-per-inch across the substrate than the spacing of the printhead ejectors, the bitmaps 402 are separated 403 into strips to create data sets 414A, 414B, etc., corresponding to the individual printheads.

In the case where multiple passes of the printhead(s) over the substrate are used to build up the print, the bitmaps 412 are separated 413 into strips to create data sets 414A, 414B corresponding to individual passes of the printhead(s).

The bitmap data 414A (only that for the first pass 'Head A is shown for convenience) is then transferred in step 418, according to the relative position of the print substrate and the printheads (as determined by the shaft encoder 416), to the pulse generation electronics 420. Here the LUT 54 is held in memory, having been downloaded previously to the pulse generation electronics from computer memory or smart-chip, typically on power-up of the printhead, and is used to translate the incoming bitmap data to values of pulse length and/or amplitude in accordance with the calibration values stored in the LUT for that printhead, which are utilised to determine the length and/or amplitude of the drive pulses that are generated 423 by the pulse generation electronics and applied to the individual printhead ejection channels. The data is transferred in time-dependency on the substrate position and offset 417 of the printhead from the location of the shaft encoder.

Figure 18:
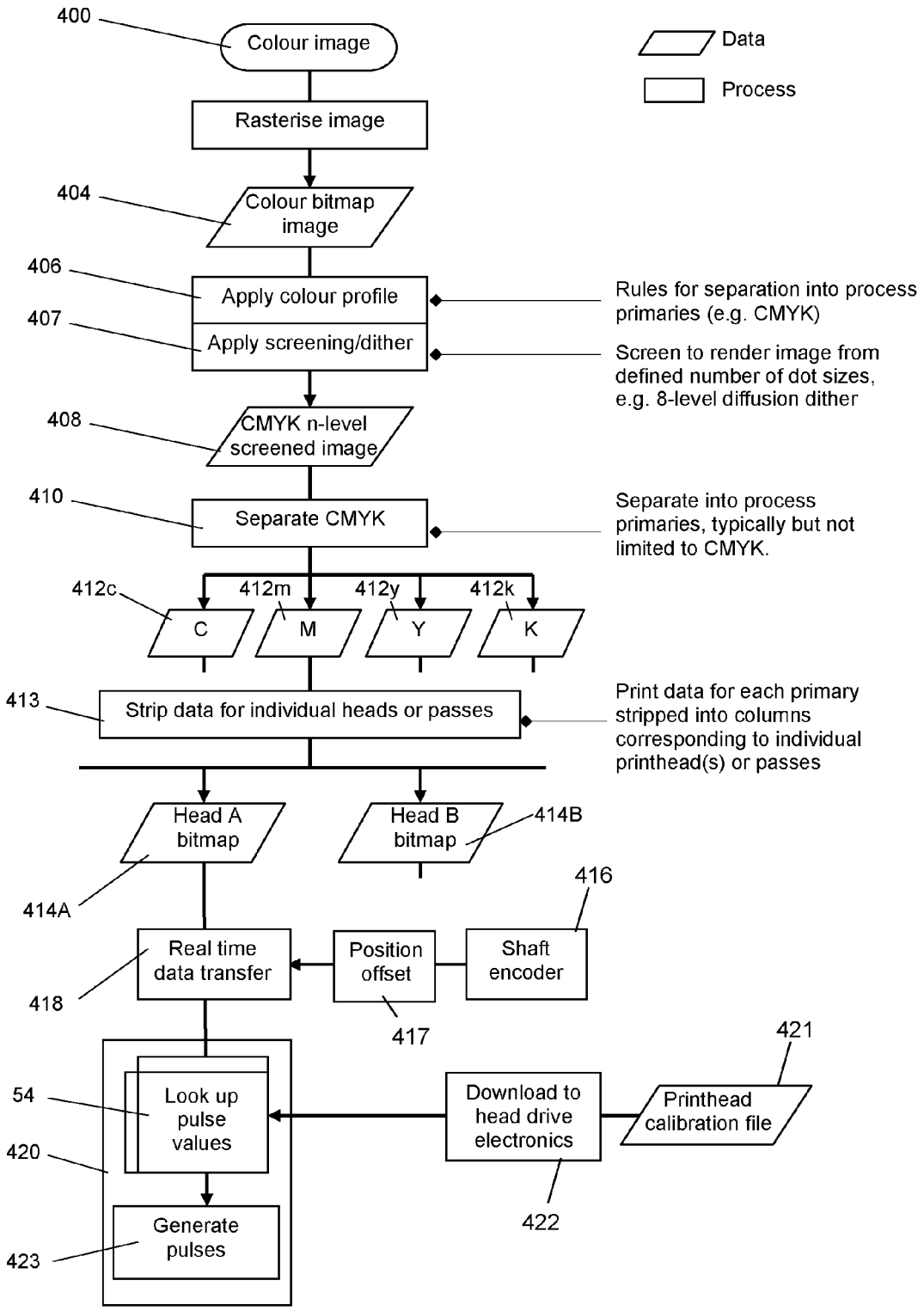
FIG. 18 is a flowchart representing the process of preparing and printing an image after calibration according to any of the examples described herein.

A variation to the implementation shown in FIG. 18 is for the LUT to reside in the controlling computer where it is used to translate the head bitmap data file 414 into pulse values before the real-time data transfer to the printhead drive electronics. In this case the data transferred to the printhead drive electronics is the pulse value data, from which pulses are generated in the pulse generation electronics 420 without use of an integrated LUT.

The invention claimed is:

1. A method of calibrating a printhead for printing two-dimensional bit-mapped images having a number of pixels per row, the printhead having a row of printing channels, wherein the volume of marking fluid ejected from each printing channel in use is independently controlled by respective control pulses, such that for a given printing channel the volumes of marking fluid ejected are determined by pulse values of the control pulse and wherein the pulse values are determined by respective image pixel bit values, and wherein the pulse value required to eject a given volume of marking fluid may vary between printing channels of the printhead, the calibration method comprising:

providing an image that, when printed by an uncalibrated printhead, causes the printhead to print a plurality of rows, wherein each row is oriented parallel to the printing channels of the printhead and wherein, to print each row, each printing channel of the printhead is driven with the same pulse value, and wherein the pulse value with which the printing channels are driven varies between the rows of the image in a set of defined steps, printing one or more test prints of said image, measuring the optical density of the test print or test prints at positions arranged on a grid to obtain data of optical print density and pulse value at positions across the printhead, selecting a desired tone reproduction curve for the print process represented by optical density versus image grey level, wherein the tone reproduction curve specifies a desired optical density associated with different pixel bit values, calculating, for each printing channel, pulse values from the measured test print or test prints that are estimated to produce the desired values of optical print density corresponding to selected pixel bit values as specified by the tone reproduction curve and which may include non-printing pulse values, and recording in memory, for each printing channel across the printhead, the pulse value for each of said printing channels required to produce the desired optical density for the selected pixel bit values as specified by the tone reproduction curve.

2. A method according to claim 1, wherein a single test print of said image is provided and the pulse values are varied from maximum to minimum in the print direction along the test print prior to measuring the optical density.

3. A method according to claim 1, wherein the pulse values are varied in the print direction along the test print to print a number of bands of print at different pulse values each corresponding to one of a desired set of dot sizes that are utilised by the printer in use to render images in conjunction with a suitable screening method.

4. A method according to claim 1, wherein a plurality of blocks of print are provided in the test print, each block being printed by one of the ejection channels.

5. A method according to claim 1, further including the step of calibrating a non-ejecting level of pulse values by extrapolating from the lowest printing level pulse values.

6. A method according to claim 1, in which the control pulses are voltage pulses.

7. A method according to claim 1, further including creating an effective bias level voltage for each channel, by selectively adding to the bias voltage of certain channels non-printing voltage pulses whose amplitude or duration is not sufficient to cause ejection.

8. A method according to claim 1, wherein the step of recording in memory the pulse value for each of said positions across the printhead for each of said image grey levels, comprises storing said values in a memory forming part of the printhead.

9. A method of printing a two-dimensional bit-mapped image having a number of pixels per row, the printhead having a row of ejection channels, each ejection channel having associated ejection electrodes to which a voltage is applied in use sufficient to cause particulate concentrations to be formed from within a body of printing fluid, and wherein, during printing, in order to cause volumes of charged particulate concentrations of one of a number of predetermined volume sizes to be ejected from selected ejection channels of the printhead to form printed pixels, voltage pulse values of respective predetermined amplitude and duration, as determined by respective image pixel bit values, are applied to the electrodes of the selected ejection channels, wherein the printhead is calibrated in accordance with claim 1.

10. A method according to claim 9, wherein the individual voltage pulse values determined by the respective image pixel bit values for printing the image are modified in accordance with corresponding values stored in a look-up-table.

* * * * *